US009061288B2

(12) United States Patent
Danko et al.

(10) Patent No.: US 9,061,288 B2
(45) Date of Patent: Jun. 23, 2015

(54) DEVICE FOR RECYCLING MOLDING SAND

(71) Applicant: AKADEMIA GORNICZO-HUTNICZA IM. STANISLAWA STASZICA W KRAKOWIE, Cracow (PL)

(72) Inventors: Jozef Danko, Cracow (PL); Mariusz Holtzer, Cracow (PL); Rafal Danko, Cracow (PL); Grzegorz Holtzer, Cracow (PL); Jerzy Kuzmin, Opole (PL); Krzysztof Matuszewski, Opole (PL); Karol Przybyla, Chroscina (PL)

(73) Assignee: AKADEMIA GORNICZO-HUTNICZA IM. STANISLAWA STASZICA W KRAKOWIE, Cracow (PL)

( * ) Notice: Subject to any disclaimer, the term of this patent is extended or adjusted under 35 U.S.C. 154(b) by 211 days.

(21) Appl. No.: 13/947,154

(22) Filed: Jul. 22, 2013

(65) Prior Publication Data

US 2014/0027549 A1 Jan. 30, 2014

(30) Foreign Application Priority Data

Jul. 25, 2012 (PL) ..... 400131

(51) Int. Cl.

| | |
|---|---|
| ***B07B 9/00*** | (2006.01) |
| ***B02C 23/02*** | (2006.01) |
| ***B02C 23/14*** | (2006.01) |
| ***B02C 19/00*** | (2006.01) |
| ***B22C 5/04*** | (2006.01) |
| ***B22C 5/06*** | (2006.01) |
| ***B22C 5/08*** | (2006.01) |

(52) U.S. Cl.

CPC ..... *B02C 23/02* (2013.01); *B02C 23/14* (2013.01); *B02C 19/0056* (2013.01); *B22C 5/0481* (2013.01); *B22C 5/06* (2013.01); *B22C 5/085* (2013.01)

(58) Field of Classification Search

CPC ..... B07B 1/28; B07B 1/54; B07B 4/04; B07B 9/00; B07B 9/02; B07B 2201/04; B02C 23/02; B02C 23/14; B22C 5/06; B22C 5/10

USPC ..... 209/21, 138, 139.1, 311, 315–318, 325, 209/326, 331, 332, 365.1, 382; 241/79

See application file for complete search history.

(56) References Cited

U.S. PATENT DOCUMENTS

| | | | | | |
|---|---|---|---|---|---|
| 2,217,710 | A | * | 10/1940 | Shaler | 209/28 |
| 4,319,990 | A | * | 3/1982 | Muller | 209/240 |
| 5,213,820 | A | * | 5/1993 | Uhlemann et al. | 425/222 |
| 5,348,161 | A | * | 9/1994 | Mueller | 209/29 |
| 5,727,689 | A | * | 3/1998 | Anderson et al. | 209/139.1 |

(Continued)

*Primary Examiner* — Joseph C Rodriguez

(74) *Attorney, Agent, or Firm* — Matthias Scholl, PC; Matthias Scholl

(57) ABSTRACT

A device for recycling molding sand, the device containing a base; a vibratory reclaimer; a pneumatic cascade classifier serially connected at its upper section to the vibratory reclaimer; and at least two generators of vibrations. The vibratory reclaimer contains: a vertical column, the vertical column being hollow and cylindrical in shape, having an axis of rotation, and a side wall with at least one pour-out hole, wherein the pour-out hole is connected with a transport trough, and the transport trough is rigidly mounted and rises in a spiral fashion along the side wall and at a top end passes through a channel extending to a feeding screw for feeding recycled molding the to the pneumatic cascade classifier.

9 Claims, 5 Drawing Sheets

(56) References Cited

U.S. PATENT DOCUMENTS 6,213,307 B1 * 4/2001 Stein ..... 209/139.1
6,216,875 B1 * 4/2001 Stone ..... 209/22
7,022,363 B2 * 4/2006 Cui et al. ..... 426/482
7,614,120 B2 * 11/2009 Isbell ..... 19/41
8,061,523 B2 * 11/2011 Uebayashi et al. ..... 209/21
8,485,364 B2 * 7/2013 Krush et al. ..... 209/326
2012/0199677 A1 * 8/2012 Blo ..... 241/65

* cited by examiner

DEVICE FOR RECYCLING MOLDING SAND

CROSS-REFERENCE TO RELATED APPLICATIONS

Pursuant to 35 U.S.C. §119 and the Paris Convention Treaty, this application claims priority benefits to Polish Patent Application No. P.400131 filed on Jul. 25, 2012, the contents of which are incorporated herein by reference. Inquiries from the public to applicants concerning this document or the related application should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to a device for recycling of molding sand after it is used in a sand casting process.

2. Description of the Related Art

Molding sand, also known as foundry sand, is sand that tends to pack well and hold its shape. It is used in the process of sand casting.

Sand casting, also known as sand molded casting, is a metal casting process characterized by using sand as the mold material. The term "sand casting" can also refer to an object produced via the sand casting process. Sand castings are produced in specialized factories called foundries. Over 70% of all metal castings are produced via a sand casting process.

Sand casting is relatively cheap and sufficiently refractory even for steel foundry use. In addition to the sand, a suitable binder is mixed or occurs with the sand. The mixture is moistened, typically with water, but sometimes with other substances, to develop strength and plasticity of the clay and to make the aggregate suitable for molding. The sand is typically contained in a system of frames or mold boxes known as a flask. The mold cavities and gate system are created by compacting the sand around models, or patterns, or carved directly into the sand.

There are four main components for making a sand casting mold: base sand, a binder, additives, and a parting compound.

Binders are added to a base sand to bond the sand particles together (i.e. binders are the "glue" that hold the mold together).

A mixture of clay and water is the most commonly used binder. There are two types of clay commonly used: bentonite and kaolinite, with the former being the most common.

Oils, such as linseed oil, other vegetable oils and marine oils, used to be used as a binder, however due to their increasing cost, they have been mostly phased out. The oil also required careful baking at 100 to 200° C. (212 to 392° F.) to cure (if overheated the oil becomes brittle, wasting the mold).

Resin binders are natural or synthetic high melting point gums. The two common types used are urea formaldehyde (UF) and phenol formaldehyde (PF) resins. PF resins have a higher heat resistance than UF resins and cost less. There are also cold-set resins, which use a catalyst instead of a heat to cure the binder. Resin binders are quite popular because different properties can be achieved by mixing with various additives. Other advantages include good collapsibility, low gassing, and they leave a good surface finish on the casting. MDI (methylene diphenyl diisocyanate) is also a commonly used binder resin in the foundry core process.

Sodium silicate [$Na_2SiO_3$ or $(Na_2O)(SiO_2)$] is a high strength binder used with silica molding sand. To cure the binder carbon dioxide gas is used.

The advantage to this binder is that it occurs at room temperature and quickly. The disadvantage is that its high strength leads to shakeout difficulties and possibly hot tears in the casting.

The sand casting process progresses as follows. First, a pattern in placed in the molding sand to create a mold. Second, the pattern and the molding sand are incorporated in a gating system. Third, the pattern is removed. Fourth, the mold cavity is filled with molten metal. Fifth, the metal is allowed to cool. And sixth, the sand mold is broken away and the metal casting is removed.

While the metal casting produced in the sand casting process is the desired product, it is also beneficial to recycle the molding sand by separating off the binders, adhesives, and parting compounds so that the recycled sand particles can be reused for making sand casting molds.

Conventional methods of recycling molding sand make use of dry, vibratory reclamation to produce intensive abrasions designed to grind off layers of old binders, adhesives, and parting compounds, and to separate them from sand grains.

Various types of conventional sand reclaiming devices are known. However, in addition to being overly complex and expensive to build, conventional sand reclaiming devices direct vibrations rectilinearly to be coincident with the main direction of sand shifting. This limits the pathway along which abrasive effect is applied. Clearly, much opportunity remains for improvement in this area of technology.

SUMMARY OF THE INVENTION

The reclaimer according to this invention is different from the conventional solutions in that the pour-out holes of the cylindrical reclaiming column are connected with transport trough that is rigidly mounted and rising in a spiral fashion along the cylindrical side surface of the column.

At the top end, the transport trough is swept externally through channel being led to the feeding screw. The pour-out of the feeding screw is connected to the upper section of pneumatic cascade classifier that is connected to the same frame of the base as is the reclaimer.

It is advantageous that the transport trough throughout its height be covered externally by a pipe shield, which in the upper section is provided with connection piece being connected with exhausting installation, preferably, of the cascade classifier.

It is also advantageous that the device has two horizontal sieves: an upper sieve and a central sieve, as well as a lower conical sieve, the space behind the screening side surface of which ending at the bottom with a hole in the smaller base of cone, is closed off by bottom ring. Over the bottom ring, there is pour-out hole which is led to the transport trough, and below the conical sieve, over the column bottom, a buffer chamber is situated and filled with crushing-abrasive elements in the form of metal balls, placed on the column bottom.

In another, yet equally advantageous embodiment, in the side wall of the buffer chamber, a second pour-out hole is disposed, leading into the transport trough, the lower edge of which is situated over the column bottom at a height of no less than two diameters of the crushing-abrasive balls.

The noise which accompanies the device operation is significantly reduced, when the bottom and adjacent side walls of the buffer chamber are covered by elastic-silencing material, preferably rubber.

The horizontal upper and central sieves can be flat or else can assume the shape produced from circularly adjacent to one another, even number of circular sectors having diameter of the column. When looking down on them, the screening surfaces produced from these sectors have upper edges of walls swept down and intersecting along the lower edge, which is situated in line with a bisector of the central angle of each sector.

Intensive cooling conditions which are achieved in the device according to the invention enable the treating of used sand without pre-cooling. At the same time, the transport trough with its abrasive-cooling effect and preliminary exhausting that covers a distance of approximately 30 times greater than the column diameter, plays an essential role for providing high purity and homogeneity of reclaimed sand grains.

Whenever the term "molding sand" is used herein, it encompasses "molding sand", i.e., sand that is used as the mold material to fill the casting flask, and "core sand," i.e., sand that is used to make cores to be placed into the mold to create the interior contours of the casting.

BRIEF DESCRIPTION OF THE DRAWINGS

The invention is described hereinbelow with reference to accompanying drawings, in which.

Figure 1:
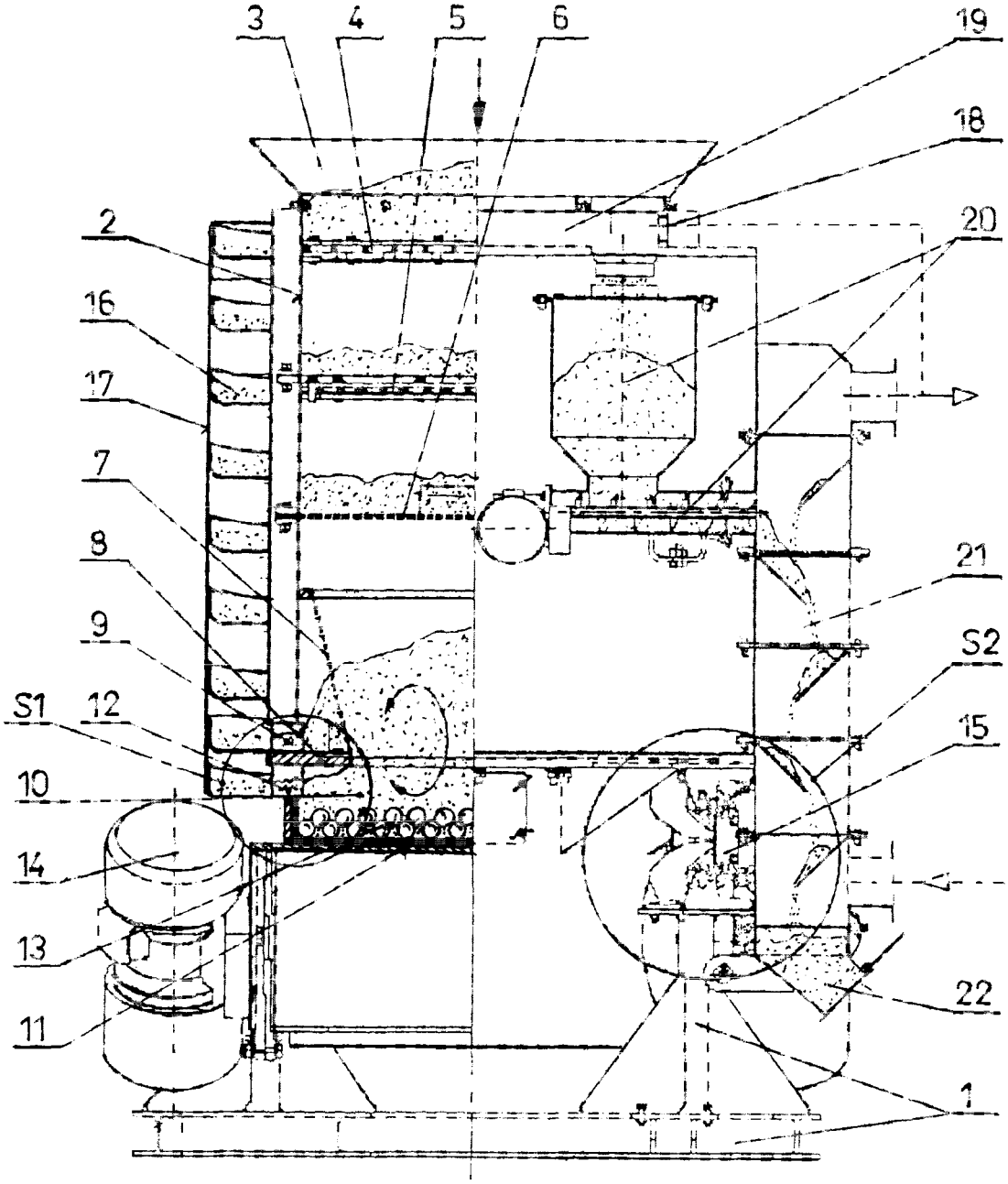
FIG. 1 shows a cross-sectional view of a device for recycling molding sand according to an exemplary embodiment of the invention.
Figure 2:
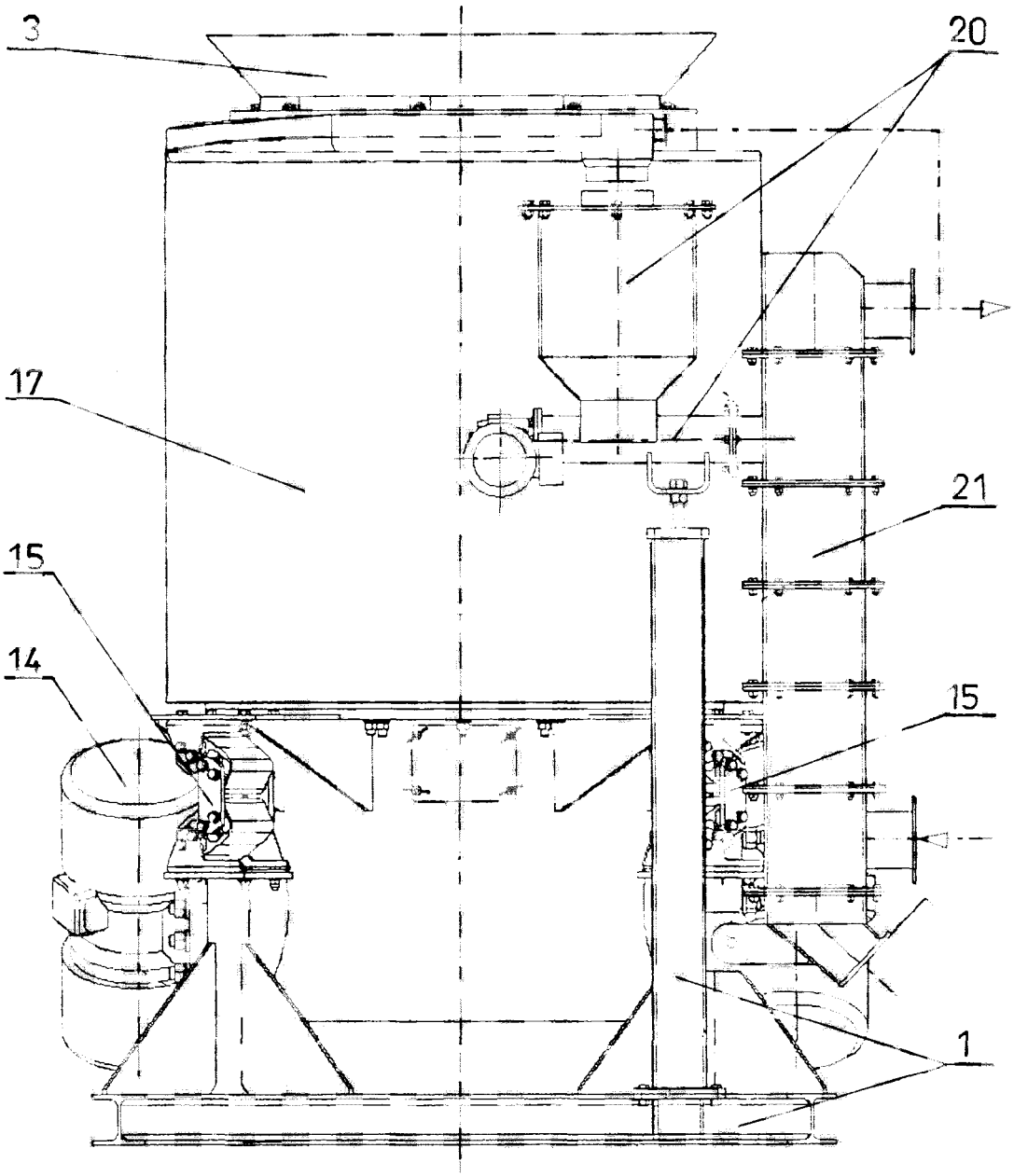
FIG. 2 shows a side elevational view of a device for recycling molding sand according to an exemplary embodiment of the invention.
Figure 3:
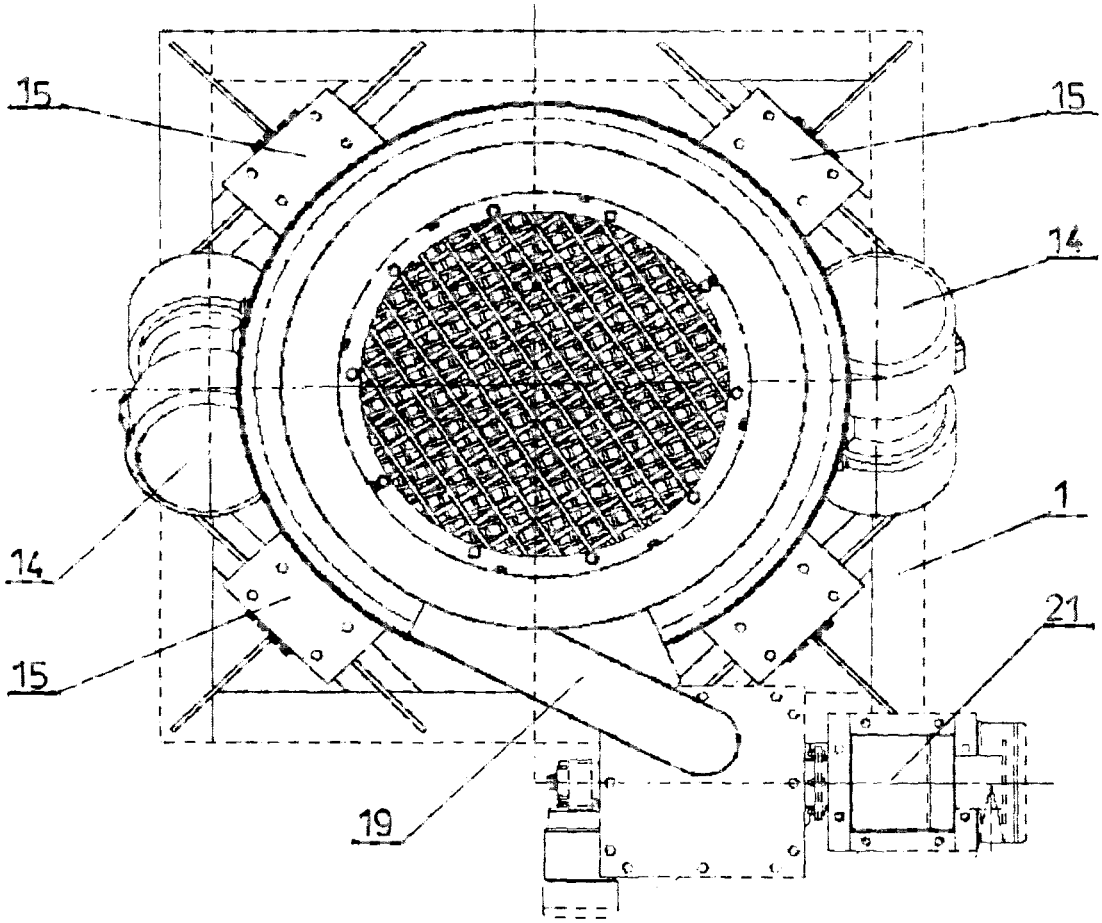
FIG. 3 shows a top plan view of a device for recycling molding sand according to an exemplary embodiment of the invention.

In the drawings, the following reference characters are used: 1. Frame of base; 2. Column; 3. Batch tank; 4. Crusher grid; 5. Upper sieve; 6. Central sieve; 7. Conical sieve; 8. Bottom ring; 9. First pour-out hole; 10. Buffer chamber; 11. Column bottom; 12. Second pour-out hole; 13. Crushing-abrasive elements; 14. Rotodynamic motor; 15. Oscillatory support; 16. Transport trough; 17. Shield; 18. Blowdown connection piece; 19. Channel; 20. Feeding screw; 21. Cascade classifier; 22. Classifier bolt; h. Height of the lower edge of the second pour-out hole; k1. Upper edge of the horizontal sieves; k2. Lower edge of the horizontal sieves; and ω. Central angle of the sector.

DETAILED DESCRIPTION OF THE EMBODIMENTS

With reference to the figures, on the frame of base 1, there are mounted and serially connected in the direction of the flow of the molding sand, the following device assemblies: the column 2, the feeding screw 20, and the cascade classifier 22.

The cylindrical column 2 consists of three vertical pipe sections, connected by a flange. On the upper section, there is mounted the batch tank 3, the bottom part of which consists of the crusher grid 4. Between the sections, at flange connection intervals, there are built up two horizontal sieves, the upper sieve 5 and the central sieve 6, with the flat riddles and gradually decreasing meshes. The mesh clearances of the upper sieve 5 are of equal dimension to a half of the clearance of the crusher grid 4, and the central sieve 6 has meshes that are 4 to 5 times smaller than the meshes of the upper sieve 5.

In the side wall of the column 2 over the upper sieve 5 and the central sieve 6, there are inspection openings. Below the central sieve 6, disposed is the conical sieve 7, with a palisade-shaped screening side surface, which ends at the bottom by the hole in the smaller cone base. The clearances between vertical rods of the palisade of the conical sieve 7 are between 1.25 to 1.5 mm, and the height of the sieve is proportional to the planned rate of material throughput.

The space behind the conical sieve 7 is closed off at the bottom by the bottom ring 8. Over the bottom ring 8, in the side wall of the column 2, disposed is a first pour-out hole 9 that is led to the outside using a short channel. Below the conical sieve 7, over the column bottom 11, there is a buffer chamber 10 filled with crushing-abrasive elements 13 in the form of metal balls that are placed at the bottom 11.

Figure 4:
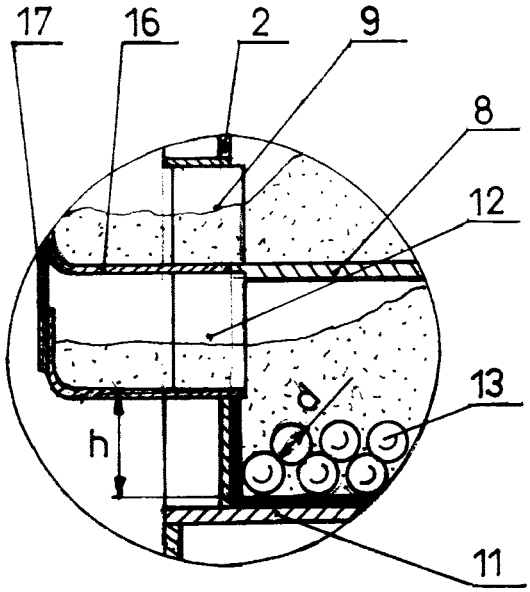
FIG. 4 shows an enlarged view of the circular area marked with the reference character S1 in FIG. 1.
Figure 5:
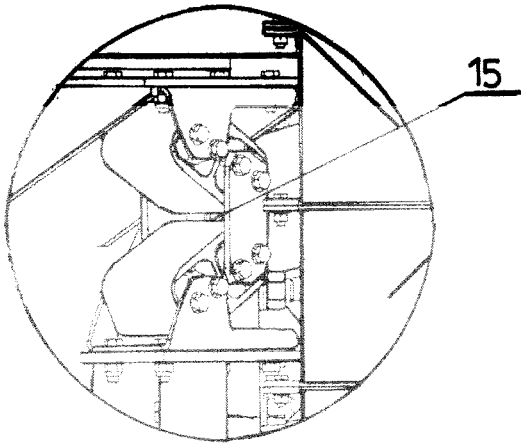
FIG. 5 shows an enlarged view of the circular area marked with the reference character S2 in FIG. 1.
Figure 6:
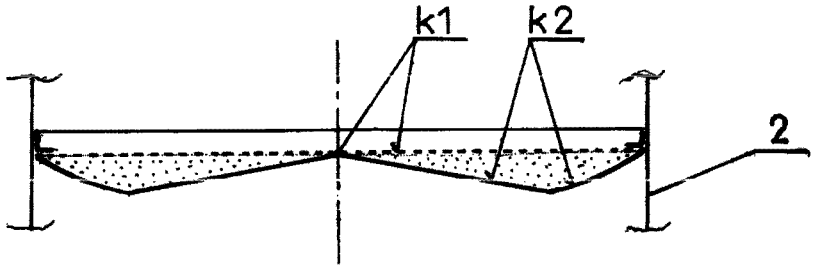
FIG. 6 shows a vertical cross-sectional view of the horizontal sieves with the rising/falling surfaces according to an exemplary embodiment of the invention.

The volume of the buffer chamber 10 is large enough to accommodate a quantity of molding sand to be recycled at a nominal productivity rate over a period of approximately 15 minutes. In accordance with the FIGS. 1 and 4, the buffer chamber 10 has on the side wall, a second pour-out hole 12 that is led to the outside by a channel, the lower edge of which channel is situated above the column bottom 11 at a height h of no less than two diameters d of the crushing-abrasive balls 13.

The bottom 11 and the adjacent side walls of the buffer chamber 10 are covered by a layer of rubber to reduce or eliminate the noise of the balls 13 striking one another. The device can effectively operate only with the pour-out hole 9 being situated behind the conical sieve 7 such that a part of the sand reclaimed in the buffer chamber 10 shifts vertically in the deposit and is mixed with the sand falling down from the sieves.

Below the bottom 11, tangentially to the reinforced lower part and outside the column 2, there are mounted two generators of vibrations in the form of rotodynamic motors 14. The motors 14 through their axes of rotation are situated in planes parallel to the axis of the column 2 and askew to that axis in the perpendicular projection.

The column 2 is mounted on the frame of base 1 using oscillatory supports 15, structured in such a way so that the column 2 produces torsional vibrations evoked by the operation of the rotodynamic motors 14.

The operation of the rotodynamic motors 14 is adjusted with the use of inverter having an adjustable frequency and amplitude of vibrations. The excitation force is set periodically with respect to a given type of the molding sand to be reclaimed. The pour-out holes 9 and 12 are connected with the column 2 through short channels having coaxial cylindrical casing.

On the short channels is wound and rigidly mounted the transport trough 16, rising in a spiral fashion along the side surface of the column 2. The transport trough 16 is covered externally throughout its height by the pipe shield 17. At the upper end, the transport trough 16 passes through the channel 19 until it reaches the feeding screw 20, the operation of which is adjusted by an inverter having an adjustable frequency. The pour-out at the end of the feeding screw 20 is connected to the upper section of the pneumatic cascade classifier 21, which is disposed on the frame of base 1.

The shield 17 of the transport trough 16 is provided in the upper section with the connection piece 18 connected with exhausting installation of the cascade classifier 21. The cascade classifier 21 is fed by the lower connection piece with air from a high-pressure blast fan, controlled by the inverter according to the signals coming from the measurement system, with the objective of acquiring the required flow of air.

Figure 7:
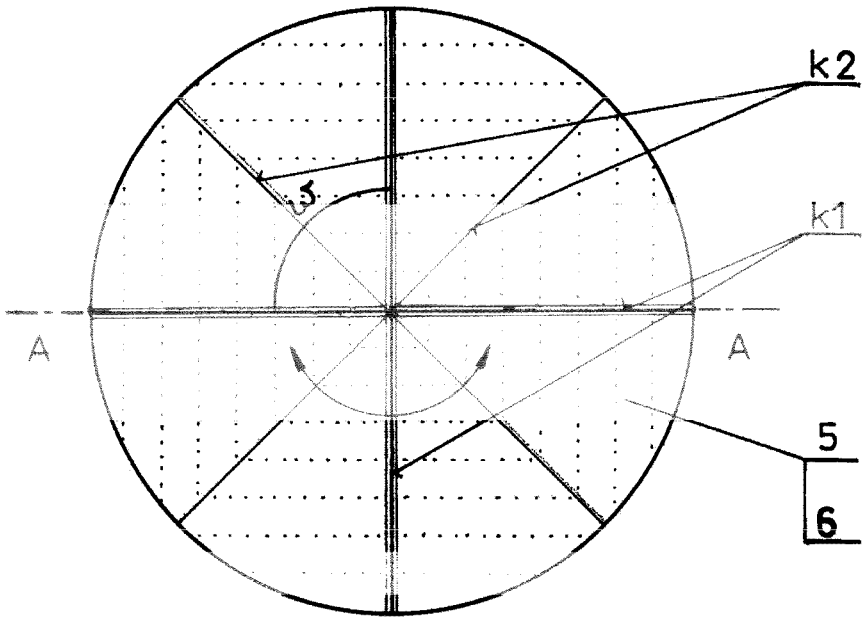
FIG. 7 shows a top plan view of the horizontal sieves with the rising/falling surfaces according to an exemplary embodiment of the invention.

With reference to FIG. 7, the horizontal sieves 5 and 6 are executed flat or with rising and falling riddle surfaces. In a top view, the screening surfaces are then made from an even number of circular sectors ω, which are circularly adjacent to one another and having diameter of the column 2, whereas the sides constitute upper edges k1 of the walls swept down and intersecting along the lower edge k2, which is situated in line with the bisector of the central angle ω of each sector.

The geometry of the sieves may be adjusted to suit optimal abrasive effect while taking into account the existing flows of the reclaimed sand.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A device for recycling molding sand, the device comprising:

(1) a base;

(2) a vibratory reclaimer disposed on said base; said vibratory reclaimer comprising:

(a) a vertical column, said vertical column being hollow and cylindrical in shape, said vertical column having an axis of rotation, and said vertical column having a side wall with at least one pour-out hole;

(b) a batch tank disposed at the top of said vertical column, (c) a crusher grid, (d) at least two sieves with gradually decreasing meshes, and (e) a column bottom closing off a lower section of said vertical column, (3) a pneumatic cascade classifier disposed on said base and serially connected at its upper section to said vibratory reclaimer; and (4) at least two generators of vibrations disposed tangentially to said vertical column below said column bottom, said generators each having an axis of rotation situated in a plane parallel to said column axis and askew to said column axis, in a perpendicular projection, wherein said pour-out hole is connected with a transport trough, and said transport trough is rigidly mounted and rising in a spiral fashion along said side wall and at a top end passes through a channel extending to a feeding screw for feeding the molding sand to said pneumatic cascade classifier.

2. The device of claim 1, wherein said transport trough is externally covered throughout its height by a pipe shield.

3. The device of claim 2, wherein in an upper section, said pipe shield comprises a connection piece connected to an exhausting installation of said pneumatic cascade classifier.

4. The device of claim 1 further comprising two horizontal sieves: an upper sieve and a central sieve, as well as a lower conical sieve, wherein a space behind a screening side surface of said lower conical sieve is closed off by a bottom ring; said first pour-out hole is disposed over said bottom ring; said first pour-out hole is connected to said transport trough; a buffer chamber is disposed below said lower conical sieve over said column bottom; and crushing-abrasive elements are disposed in said buffer chamber at said column bottom.

5. The device of claim 4, wherein said crushing-abrasive elements are metal balls; a second pour-out hole is disposed in said side wall, said second pour-out hole leads to said transport through; and a lower edge of said second pour-out hole is disposed over said column bottom at a height (h) that is no less than two diameters of said metal balls.

6. The device of claim 4, wherein a bottom and adjacent side walls of said buffer chamber are covered by elastic-silencing material.

7. The device of claim 5, wherein a bottom and adjacent side walls of said buffer chamber are covered by elastic-silencing material.

8. The device of claim 1, wherein said two horizontal sieves each comprise:

(a) screening surfaces made from an even number of circular sectors that are circularly adjacent to one another, each having a diameter of said vertical column, and (b) sides formed by upper edges (k1) sweeping down and intersecting along lower edge (k2), which is situated in line with a bisector of a central angle (ω) of each sector.

9. The device of claim 4, wherein said two horizontal sieves each comprise:

(a) screening surfaces made from an even number of circular sectors that are circularly adjacent to one another, each having a diameter of said vertical column, and (b) sides formed by upper edges (k1) sweeping down and intersecting along lower edge (k2), which is situated in line with a bisector of a central angle (ω) of each sector.

* * * * *